US010793347B2

(12) United States Patent
Rea et al.

(10) Patent No.: US 10,793,347 B2
(45) Date of Patent: Oct. 6, 2020

(54) MACHINE FOR FORMING FILTER BAGS FOR INFUSION PRODUCTS

(71) Applicant: I.M.A. INDUSTRIA MACCHINE AUTOMATICHE S.P.A., Ozaano Dell'Emilia (Bologna) (IT)

(72) Inventors: Dario Rea, Monterenzio (IT); Sauro Rivola, Riolo Terme (IT); Fabio Pasini, Ozzano Dell'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 198 days.

(21) Appl. No.: 16/074,500

(22) PCT Filed: Feb. 21, 2017

(86) PCT No.: PCT/IB2017/050973
§ 371 (c)(1),
(2) Date: Aug. 1, 2018

(87) PCT Pub. No.: WO2017/145044
PCT Pub. Date: Aug. 31, 2017

(65) Prior Publication Data

US 2019/0047781 A1 Feb. 14, 2019

(30) Foreign Application Priority Data

Feb. 24, 2016 (IT) ..... 102016000019170

(51) Int. Cl.
*B65D 85/808* (2006.01)
*B65B 29/04* (2006.01)
(Continued)

(52) U.S. Cl.
CPC ..... *B65D 85/808* (2013.01); *B65B 29/028* (2017.08); *B65B 29/04* (2013.01); *B65B 43/50* (2013.01); *B65B 43/60* (2013.01)

(58) Field of Classification Search
CPC ..... B65D 85/808; B65B 9/06; B65B 11/28; B65B 11/48; B65B 29/00; B65B 29/02;
(Continued)

(56) References Cited

U.S. PATENT DOCUMENTS 3,198,352 A * 8/1965 Puechberty ..... B07C 3/08 198/349.3
3,805,483 A * 4/1974 Romagnoli ..... B65B 29/04 53/134.2
(Continued)

FOREIGN PATENT DOCUMENTS

EP 762973 A1 3/1997
EP 762974 A1 3/1997
(Continued)

OTHER PUBLICATIONS

International Search Report dated May 3, 2017 from counterpart PCT App PCT/IB2017/050973.

*Primary Examiner* — Hemant Desai
*Assistant Examiner* — Jacob A Smith
(74) *Attorney, Agent, or Firm* — Shuttleworth & Ingersoll, PLC; Timothy J. Klima

(57) ABSTRACT

A machine for forming filter bags for infusion products including a first movement carousel rotating continuously about a first axis of rotation; a plurality of first gripping means positioned along, and movable continuously with, the first carousel; a plurality of first operating stations positioned along, and movable continuously with, the first movement carousel; each first operating station is associated with a corresponding first gripping means; each first operating station is configured to operate on the piece of filter material
(Continued)

in order to form, at least partly, a filter bag along a predetermined angular stretch of rotation of the first movement carousel; and a plurality of first translation devices, associated with the first movement carousel and configured for translating, mutually, the first operating stations and the corresponding first gripping means along a direction parallel to the axis of rotation.

24 Claims, 8 Drawing Sheets

(51) Int. Cl.
*B65B 43/50* (2006.01)
*B65B 29/02* (2006.01)
*B65B 43/60* (2006.01)

(58) Field of Classification Search
CPC ..... B65B 29/028; B65B 29/04; B65B 35/16; B65B 43/50; B65B 43/60
USPC ..... 53/558, 134.2, 413, 228, 232, 233, 234, 53/466
See application file for complete search history.

(56) References Cited

U.S. PATENT DOCUMENTS 4,288,224 A * 9/1981 Romagnoli ..... B65B 29/04 493/345
4,853,071 A * 8/1989 Romagnoli ..... B65B 29/028 53/134.2
4,885,896 A * 12/1989 Romagnoli ..... B65B 61/24 53/116
5,852,917 A * 12/1998 Romagnoli ..... B65B 61/24 53/479
6,050,059 A * 4/2000 Rea ..... B65B 11/54 53/413
6,499,273 B1 * 12/2002 Marzocchi ..... B65B 29/04 493/226
6,675,553 B2 * 1/2004 Lohrey ..... B65B 35/46 414/790.4
6,711,876 B1 * 3/2004 Benedetti ..... B65B 29/04 493/375
6,807,793 B1 * 10/2004 Romagnoli ..... B65D 85/812 493/375
7,188,458 B2 * 3/2007 Rea ..... B29C 65/086 53/134.2
7,335,152 B2 * 2/2008 Jensen ..... B21D 28/26 29/465
7,559,185 B2 * 7/2009 Conti ..... B65B 9/04 53/559
7,587,966 B2 * 9/2009 Nakakado ..... B26D 1/405 83/343
8,037,664 B2 * 10/2011 Squarzoni ..... B65B 19/228 53/466
8,333,050 B2 * 12/2012 Rea ..... B29C 66/1122 53/134.2
2002/0139086 A1 * 10/2002 Ghirlandi ..... B65B 29/028 53/413
2004/0226263 A1 * 11/2004 Romagnoli ..... B65B 29/028 53/134.2
2009/0241468 A1 * 10/2009 Bernardi ..... B65B 35/20 53/77
2011/0047937 A1 * 3/2011 Tsuji ..... B65B 51/30 53/413
2013/0045848 A1 * 2/2013 Rea ..... B65B 9/20 493/267
2017/0233120 A1 * 8/2017 Spatafora ..... B65D 85/808 53/134.2

FOREIGN PATENT DOCUMENTS

EP 765274 A1 4/1997
EP 1384664 A1 1/2004
EP 1818264 A1 8/2007
EP 2740676 A1 6/2014
GB 2201935 A 9/1988
WO WO9631395 10/1996
WO WO9631398 10/1996
WO WO9631399 10/1996
WO WO2010067290 A1 6/2010

* cited by examiner

MACHINE FOR FORMING FILTER BAGS FOR INFUSION PRODUCTS

This application is the National Phase of International Application PCT/IB2017/050973 filed Feb. 21, 2017 which designated the U.S.

This application claims priority to Italian Patent Application No. 1 0201 600001 91 70 filed Feb. 24, 2016, which application is incorporated by reference herein.

TECHNICAL FIELD

This invention relates to a machine for forming filter bags for infusion products, such as tea, coffee, camomile (in powder, granular or leaf form).

BACKGROUND ART

The term filter bags is used to indicate at least two types of filter bag: the single-chamber filter bags, comprising, in a minimum configuration, a piece of filter material forming a chamber containing a dose of infusion product; and the double-chamber filter bags, again comprising a single piece of filter paper, but forming two separate chambers. Each chamber contains a dose of infusion product. The two chambers are folded towards each other forming a single upper end (in the shape of an upturned "V") and a bottom end in the shape of a "W".

The single-chamber and double-chamber filter bags can also be equipped with a tag and a tie string connecting the tag to the filter bag.

Lastly, an overwrap envelope may be added to the above mentioned filter bags for wrapping and closing the single filter bag, in a hermetic or non-hermetic manner.

A type of machine, used for making filter bags of the type called two-lobed, is known from patent documents EP762973, EP762974 and EP765274 (all in the name of the same Applicant). The machine extends along a forming and feeding line on which are positioned:

- a station for feeding a web of filter paper along a feed surface;
- a station for feeding doses of product on the web of filter paper at predetermined distances;
- a tabularisation station for folding the strip on itself, wrapping the doses of product and, subsequently, longitudinally joining the strip;
- a station for folding individual pieces of filter paper with double chamber;
- a carousel, equipped with radially protruding grippers, positioned beneath the folding station and configured to receive individual pieces of folded filter paper; the carousel, moved stepwise about a horizontal axis, rotates each piece of filter paper to the operating stations, arranged one after another and stationary relative to a frame of the machine, to associate to the piece of filter paper a string, suitably wrapped around the piece of filter paper, and a tag in turn connected to the string.

In some machine solutions, depending on the type of filter bag to be formed, there may be (alternatively):

- a station for folding the open ends of the two chambers of the piece along the path of the carousel with their retaining by the knotting of the string on the same piece; or
- a further station for transversal closing of the ends of the piece before or at the same time as the separation from the remaining film.

The machine may also comprise a station for applying a sheet of overwrapping material for each filter bag positioned along the path of the carousel, or at a further carousel.

A solution of the machine with a station for applying a sheet of overwrapping material to the filter bag is known in patent document EP 1 384 664 which illustrates a rotary carousel equipped with a plurality of grippers for gripping individual filter bags moved individually towards an station for applying the overwrapping sheet.

The machine structured as described above operates intermittently, that is to say, stepwise for all the stations present along the feed line.

The stepwise operation places a limit on the productivity of the machine.

DISCLOSURE OF THE INVENTION

The aim of this invention is to provide a machine for forming filter bags for infusion products with a productivity greater than the productivity of the prior art machines, maintaining a high quality of the filter bag.

More specifically, the aim of this invention to provide a machine for forming filter bags for infusion products with reduced dimensions and high flexibility.

These aims are fully achieved by a machine for forming filter bags for infusion products according to the present disclosure.

BRIEF DESCRIPTION OF THE DRAWINGS

The invention will be described with reference to the accompanying drawings, provided by way of example only and without limiting the scope of the invention, in which.

DETAILED DESCRIPTION OF PREFERRED EMBODIMENTS OF THE INVENTION

Figure 1:
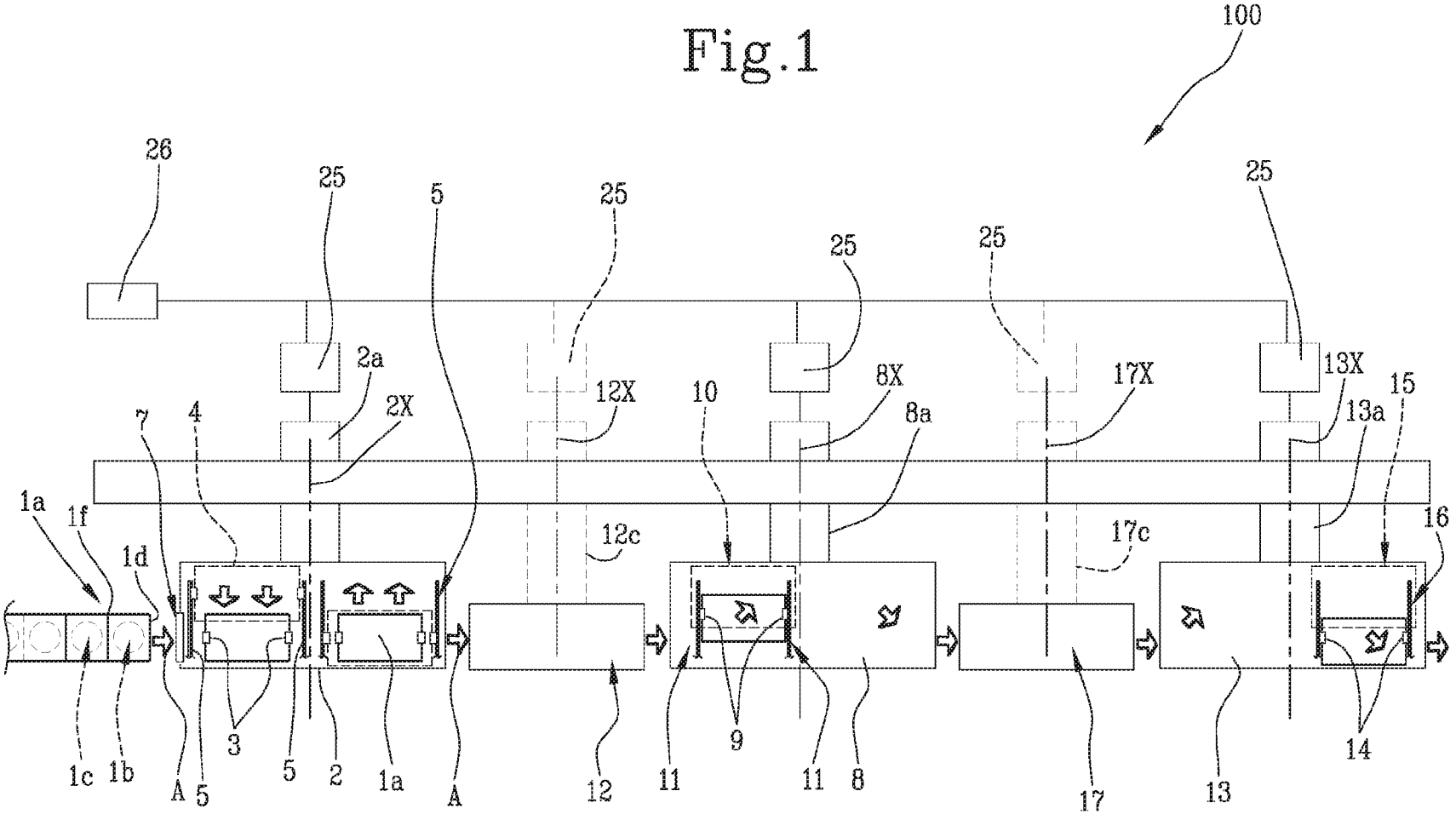
FIG. 1 is a schematic top plan view of a machine for making filter bags containing infusion products according to a first preferred embodiment of the invention.

A machine according to the invention, labelled 100 in its entirety, is used for making filter bags 1 containing infusion products, such as tea, coffee, camomile dosed in powder, granular or leaf form.

The expression "filter bags" is used to indicate at least two types of filter bag.

A first type, known as single-chamber, comprises a piece of filter material forming a single chamber containing a dose of infusion product.

A second type of filter bag, known as double-chamber, comprises a single piece 1*a* of filter material, which forms two separate chambers 1*b*, 1*c*. Each chamber 1*b*, 1*c* contains a dose of infusion product. The two chambers 1*b*, 1*c* are folded towards each other forming a single upper end (in the shape of an upturned "V") and a bottom end in the shape of a "W".

These two types of filter bag may be equipped with a gripping tag 1*t* and a tie string 1*g* connecting the tag 1*t* to the filter bag 1 formed.

An outer overwrapping envelope may also be added to wrap around and enclose each single filter bag 1 formed.

The machine 100, according to the invention, starts from the concept of being able to obtain various types of filter bag, including those mentioned above (from the simpler single-chamber filter bag to the more complex double-chamber bag with tie string and tag in overwrap envelope) adding, when necessary, operating stations designed to perform the requested operation on the piece of filter material or on the filter bag (folding and/or applying tie string and tag, and/or applying outer overwrapping envelope, etc), whilst maintaining a continuous operation of the machine.

The machine 100 for forming filter bags 1 for infusion products starting from pieces 1*a* of filter material, each having at least one dose of infusion product and advancing along a feed line A, comprising a first movement carousel 2 rotating continuously about a first axis 2X of rotation.

Reference will be made in the following description to pieces of filter material being formed, meaning any one of the intermediate configurations of, and prior to, the finished filter bag, with or without the outer overwrapping envelope.

The machine 100 comprises a plurality of first gripping means 3 positioned along, and continuously movable with, the first movement carousel 2.

Each first gripping means 3 is configured for holding a respective piece 1*a* of filter material being formed.

The machine 100 also comprises a plurality of first operating stations 4 positioned along, and movable continuously with, the first movement carousel 2.

Each first operating station 4 is associated with a corresponding first gripping means 3.

Each first operating station 4 is configured to operate on the piece 1*a* of filter material in order to form, at least partly, a filter bag 1 along at least one predetermined angular stretch of rotation of the first movement carousel 2.

Advantageously, the first operating station 4 acts in conjunction with the corresponding first gripping means 3 for retaining the respective piece 1*a* of filter material being formed.

Figures 8, 9:
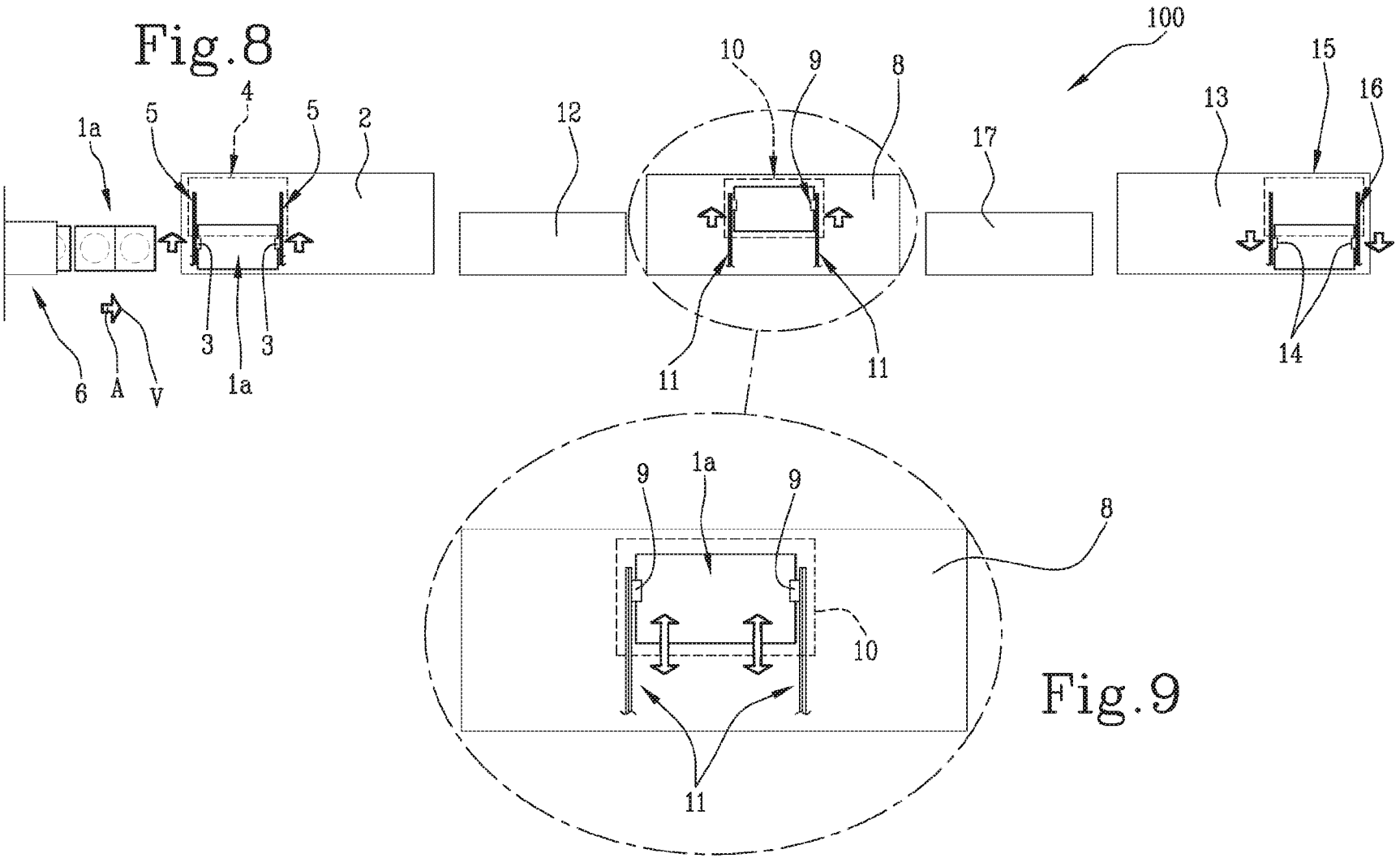
FIG. 8 is a schematic top plan view of a machine for making filter bags containing infusion products according to a second preferred embodiment of the invention.
FIG. 9 is a schematic top plan view of a movement carousel of the machine of FIG. 8.

The machine 100 also comprises a plurality of first translation devices 5, associated with the first movement carousel 2 and configured for translating, mutually, the first operating stations 4 and the corresponding first gripping means 3 along a direction parallel to the axis 2X of rotation (see FIGS. 1, 8 and 9).

Advantageously, the first translation devices 5 may be of the cam type, or comprise electric motors.

In short, the basic concept of the machine 100 is that it comprises a multiplicity of operating units, all operating a same operation on the piece of filter material, all independent of each other and driven continuously about an axis of rotation.

Moreover, at the infeed area of the movement carousel 2, at which the piece 1*a* is fed to the carousel 2, the first operating station 4 and the corresponding first gripping means 3 are offset horizontally, that is, positioned on different vertical planes, in such a way as to allow the piece 1*a* of be easily received from the corresponding gripping means 3.

In effect, it should be noted that the first movement carousel 2 has a circumferential surface extending parallel to the first axis 2X.

Each first operating station 4 is positioned on a first part of the circumferential surface and close to an edge of the first carousel 2.

Each first gripping means 3 is positioned along a second part of the circumferential surface of the first carousel 2 (preferably on the edge opposite the circumferential surface).

In this way, each first operating station 4 and the corresponding first gripping means 3 are positioned on different vertical planes, referred to the circumferential surface of the first carousel 2, at least for a stretch of the line A for feeding the pieces 1*a* of filter material being formed.

Next, a mutual movement, along a direction parallel to the first axis 2X of rotation, between the first operating station 4 and corresponding first gripping means 3 places the first operating station 4 and corresponding first gripping means 3 on a single vertical plane, in such a way that the first operating station 4 is positioned at the piece 1*a* and can perform one or more operations on the latter.

Upon completion of the operations, the first translation devices 5 again translate mutually the first operating station 4 and the corresponding first gripping means 3, in such a way that, at an outfeed area of the movement carousel 2, the piece 1*a* is free to be transferred to a subsequent processing step/station, for example a second movement carousel.

This configuration allows an intermediate operation or the completion of the filter bag to be obtained on a large number of pieces of filter material per unit of time and in a reduced space (angular section).

Preferably, each first operating station 4 and the corresponding first gripping means 3 are positioned on different vertical planes, at least for a stretch of the line A for feeding the pieces 1*a* of filter material being formed.

In a first solution, each first translation device 5 is configured to translate a corresponding first gripping means 3 along a direction parallel to the first axis 2X of rotation of the first movement carousel 2 and bring a piece 1*a* of filter material, positioned on the corresponding first gripping means 3, to a corresponding first operating station 4 (in particular see FIGS. 8 and 9).

In light of this, the first movement carousel 2 moves the pieces 1*a* of filter material being formed along a feed direction lying on more than one vertical plane.

In other words, according to the first solution, at the first movement carousel 2, the feed line A lies on more than one vertical plane.

In this first solution, the first operating stations 4 are stationary relative to the first movement carousel 2, that is, rotatable integrally with the first movement carousel 2, and they are maintained on a single vertical plane.

In short, the first gripping element 3 translates, thanks to the corresponding first translation device 5, parallel to the first axis 2X of rotation to bring the piece 1*a* of filter material to the first operating station 4, which performs one or more operations on the piece 1*a* of filter material being formed. Upon completion of the operations on the piece 1*a* of filter material, the first translation device 5 translates the first gripping means 3, and the piece 1*a* of filter material, away from the corresponding first operating station 4.

In a second solution, the first translation devices 5 are configured to translate along a direction parallel to the axis 2X of rotation of the first movement carousel 2, and bring corresponding first operating stations 4 to corresponding first gripping means 3 and respective pieces 1*a* of filter material, at least for a stretch of the feed line A (see first movement carousel 2 in FIG. 1), along which the first operating stations 4 perform one or more operations on the piece 1*a* of filter material being formed.

In other words, in the second solution, the first gripping means 3 are stationary relative to the first movement carousel 2, that is, rotatable integrally with the first movement carousel 2, and they are maintained on a single vertical plane. Upon completion of the operations on the piece 1*a* of filter material, the first translation device 5 translates the first operating station 4 away from the corresponding first gripping means 3 parallel to the first axis 2X of rotation, the piece 1*a* of filter material remaining held by the first gripping means 3.

Thanks to this structuring, a single carousel equipped with a plurality of units, each comprising a gripping means, an operating station and a translation device, may be used in various ways, depending on the type of operation to be performed on the piece of filter material, or the type of filter bag to be formed.

For example, according to a first solution, it is possible to feed to the movement carousel pieces of filter material (single-chamber or double-chamber, without distinction) already folded and closed, to which it is only necessary to add string and tags: in this case, the operating stations are stations for applying the tie string and tag.

In a second solution, it is possible to feed to the movement carousel pieces of filter material in a tubular shape and the operating stations are folding and closing stations designed to fold and close the piece for making a filter bag without the tie string and tag.

Further, according to a third solution, it is possible to feed to the movement carousel finished filter bags (single-chamber or double chamber, without distinction, either with or without the tie string and tag), to which it is necessary to add an outer overwrapping envelope: in this case, the operating stations will be stations for applying and sealing a sheet of overwrapping material provided with sealing means.

Therefore, the first operating station 4 may be configured to perform intermediate operations on the piece 1*a* of filter material (folding and closing of the piece), or to perform terminal operations and form a complete filter bag 1 starting from a piece of filter material (applying tie string and tag to pieces folded and closed), or to perform auxiliary operations on a complete filter bag 1 (application and sealing of a sheet of overwrapping material) along at least one predetermined angular stretch of rotation of the first movement carousel (2).

From these three examples it can already be noted how the solution proposed has characteristics of high operational flexibility, together with high productivity.

The structure of the units, each consisting of gripping means, operating stations and translation devices distributed along the carousel, allows the actuator and control devices to be simplified and, preferably, to join them together in the proximity of the axis of rotation in such a way as to reduce the machine dimensions and maintain a high level of precision.

Described below is a machine 100 according to the invention designed for making double-chamber filter bags with string and tag in an outer heat-sealed envelope starting from a continuous tubular strip of filter material containing doses of product arranged in succession.

Figure 2:
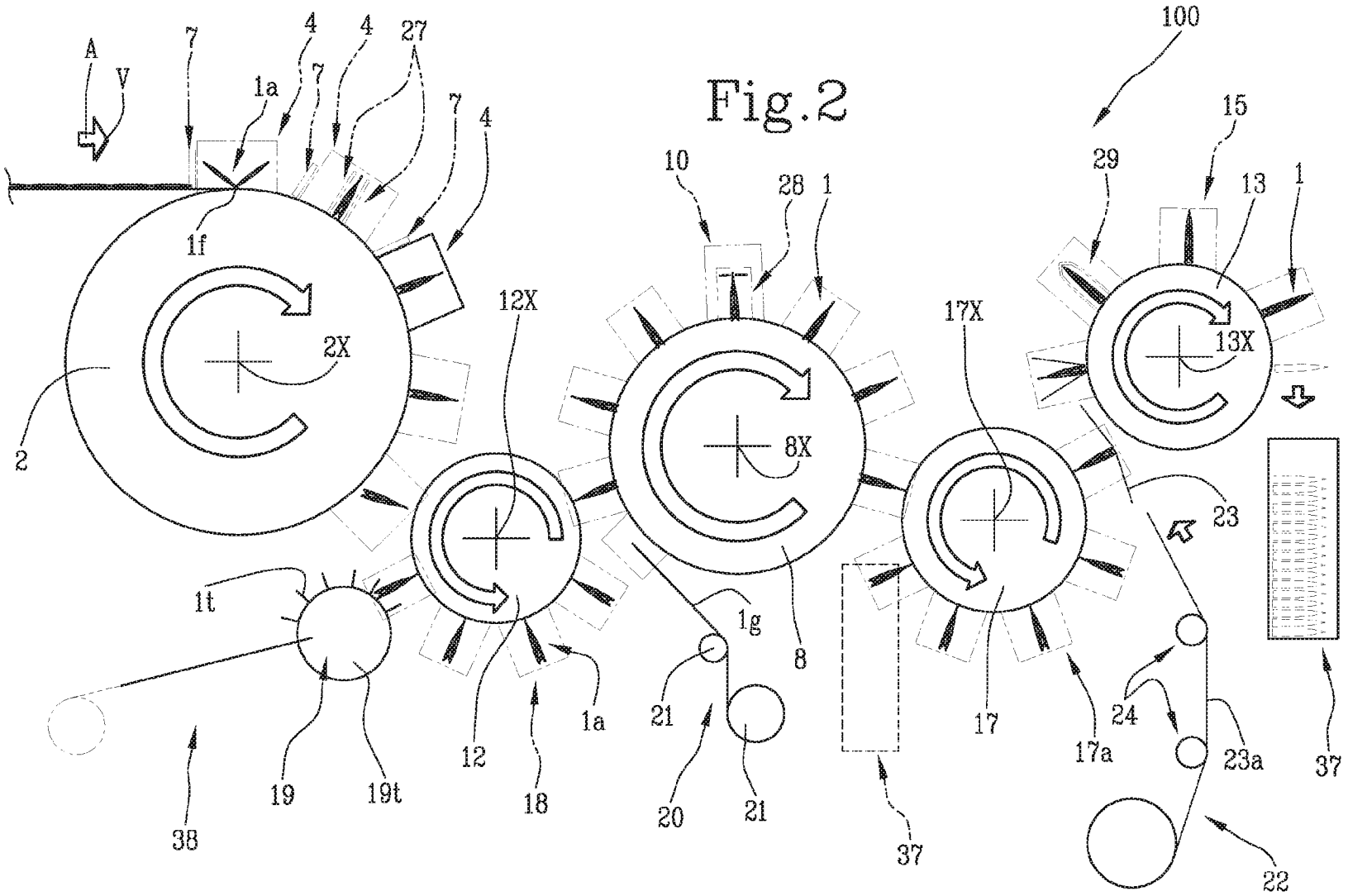
FIG. 2 is a schematic front view of the machine of FIG. 1.

As illustrated in FIGS. 1, 2 and 8, a continuous strip of filter material in a tubular shape having a succession of doses of infusion product spaced from each other is fed to the first movement carousel 2.

The continuous strip advances, continuously, along the feed line A with a feed direction V directed towards the first carousel 2.

The machine 100 comprises a plurality of cutting means 7 positioned on, and movable in rotation with, the first movement carousel 2. Each cutting means 7 is positioned between, and associated with, a first operating station 4 and the corresponding first gripping means 3.

The cutting means 7 are configured to separate the continuous strip of filter material in order to obtain a single piece 1*a* of filter material having two free ends 1*d* and 1*e* and an intermediate portion 1*f* (designed to form the bottom of the filter bag 1 formed), between each free end 1*d* and 1*e* and the intermediate portion 1*f* there being, respectively, two chambers 1*b*, 1*c* containing a corresponding dose of product.

Figure 3A:
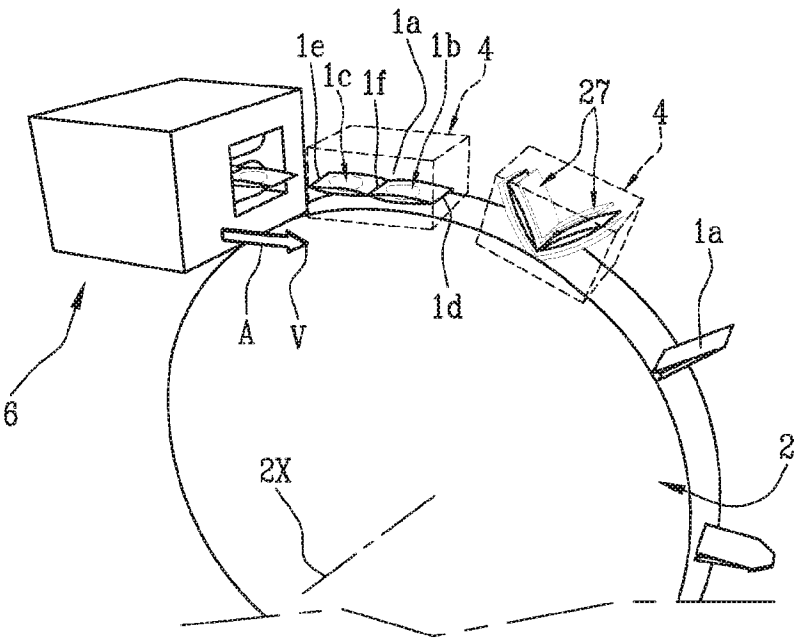
FIGS. 3 and 3*a* are respective schematic perspective views of a first movement carousel of the machine of FIGS. 1 and 2, in two alternative embodiments.

Alternatively, as illustrated in FIG. 3*a*, a forming unit 6 configured to form single pieces 1*a* of filter material feeds these pieces 1*a* of filter material to the first movement carousel 2 and the cutting means 7 on the first movement carousel 2 can be omitted.

The pieces 1*a* of filter material (regardless of whether they are fed as such to the first movement carousel 2, or cut on the first movement carousel 2 from a continuous strip) feed continuously, along the line feed line A with a feed direction V, from an infeed area to an outfeed of the first movement carousel 2.

If the machine 100 must form two-lobed type filter bags with string and tag and, if necessary, wrapped in a sheet of overwrapping material, the machine 100, thanks to the relative modularity structure/flexibility comprises two or more movement carousels which are able to perform the steps/operations necessary for the complete formation of the filter bag 1.

Figure 3:
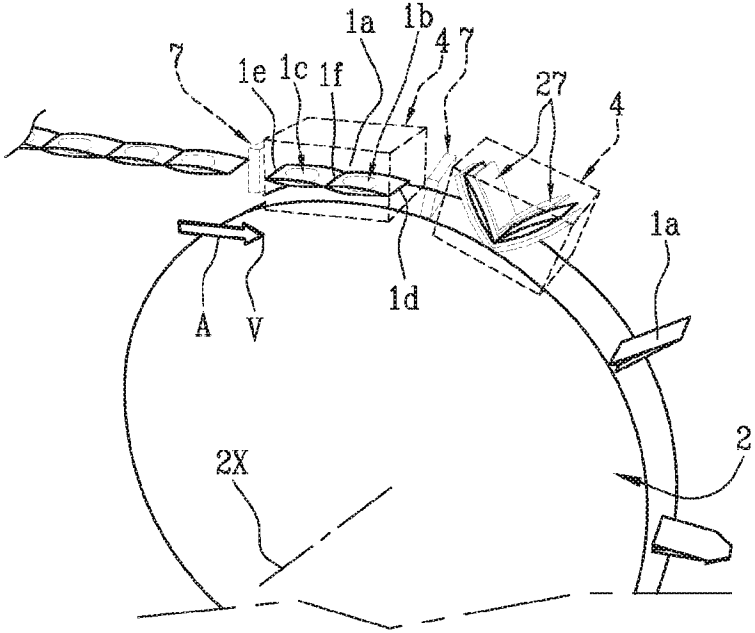

With particular reference to FIGS. 1, 2 and 3, the first movement carousel 2 comprises a plurality of first operating stations 4, each first operating station 4 being equipped with folding means 27 designed to fold towards each other the two chambers 1*b*, 1*c* of the piece 1*a* of filter material along a predetermined angular stretch of rotation of the first movement carousel 2.

It should be noted that the first movement carousel 2 rotates continuously in a clockwise direction.

In this example, each of the first gripping elements 3 is stationary relative to the first movement carousel 2. Each first operating station 4 is connected to the first translation devices 5 for translating parallel to the first axis 2X of rotation in order to move to the corresponding piece 1*a* of filter material received by the first gripping means 3, and performing the folding of the piece 1*a* of filter material.

Alternatively (see FIG. 8), the first movement carousel 2 may be configured with the first gripper means 3 connected to the first translation devices 5 and therefore translatable towards and away from the first operating stations 4.

In the embodiment illustrated in FIGS. 1 to 7, the machine 100 comprises a second carousel 8 for continuous rotary movement about a second 8X axis of rotation, positioned alongside the first carousel 2 (see FIGS. 1, 2, 4 and 5).

The machine 100 also comprises a plurality of second gripping means 9 positioned along, and movable continuously with, the second movement carousel 8.

Each second gripping means 9 is configured to receive and retain a piece 1*a* of filter material being formed (folded in the first movement carousel 2) coming from, and synchronized with, the first carousel 2.

The machine 100 also comprises a plurality of second operating stations 10 positioned along, and movable with, the second carousel 8, each second operating station 10 being associated with corresponding second gripping means 9.

Each operating station 10 is configured to operate on the piece 1*a* of filter material in order to further form, at least partly, a filter bag 1 along at least one predetermined angular stretch of rotation of the second movement carousel 8.

Advantageously, the second operating station 10 acts in conjunction with the corresponding second gripping means 9 for retaining the respective piece 1*a* of filter material being formed.

The machine 100 also comprises a plurality of second translation devices 11, associated with the second movement carousel 8 and configured for translating, mutually, the second operating stations 10 and the corresponding second gripping means 9 along a direction parallel to the second axis 8X of rotation.

Advantageously, the second translation devices 11 can be of the cam type, or comprise electric motors.

Preferably also on the second carousel 8, each second operating station 10 and the corresponding second gripping means 9 are positioned on different vertical planes, at least for a stretch of the line A for feeding the pieces 1*a* of filter material being formed. More specifically, each second operating station 10 and the corresponding second gripping means 9 are positioned on different vertical planes at an infeed area and an outfeed area of the second movement carousel 8, wherein the piece 1*a* is received and, respectively, transferred from the second movement carousel 8.

It should be noted that the second carousel 8 has a circumferential surface extending parallel to the second axis 8X In light of this, each second operating station 10 is positioned on a first part of the circumferential surface and close to an edge of the second carousel 8.

Again in light of this, each second gripping means 9 is positioned along a second part of the circumferential surface of the second carousel 8 (preferably towards the opposite edge of the second carousel 8).

Therefore, each second operating station 10 and the corresponding second gripping means 9 are positioned on different vertical planes, referred to the circumferential surface of the second carousel 8, at least for a stretch of the line A for feeding the pieces 1*a* of filter material being formed. In the example illustrated in FIGS. 1, 2, 4, 5 and 8, each second translation device 11 is configured to translate a corresponding second gripping means 9 along a direction parallel to the second axis 8X of rotation of the second movement carousel 8 to bring a piece 1*a* of filter material, positioned on the corresponding second gripping means 9, to a corresponding second operating station 10.

The second movement carousel 8 moves the pieces 1*a* of filter material being formed along a feed direction lying on more than one vertical plane.

In other words, at the second movement carousel 8 the line A for feeding the pieces 1*a* of filter material being formed lies on more than one vertical plane.

Alternatively, the second carousel 8 may be set up in such a way that the second translation devices 11 are configured to translate corresponding second operating stations 10 along a direction parallel to the second axis 8X of rotation of the second movement carousel 8 to bring the corresponding second operating stations 10 to the pieces 1*a* of filter material at least for a stretch of the feed line A.

The second movement carousel 8 has the second operating stations 10 configured to operate on a respective piece 1*a* of filter material and form a complete filter bag 1 along at least one predetermined angular stretch of rotation of the second movement carousel 8.

In light of this, in the embodiment illustrated, each second operating station 10 is equipped with joining means 28 designed to join the string 1*g* to the tag 1*t* and to the joined ends 1*d* and 1*e* of the piece 1*a* of filter material. The second operating stations 10 operate on the piece 1*a* of filter material along a predetermined angular section of the second movement carousel 8, to define a filter bag 1 equipped with tie string 1*g* and tag 1*t*.

In short, in the example illustrated, the piece 1*a* of filter material coming out from the first movement carousel 2 is folded and without the string and tag, whilst coming out from the second movement carousel 8 the piece 1*a* of filter material is equipped with the string and tag and defines a finished filter bag 1.

It should be noted that the second movement carousel 8 rotates continuously in a clockwise direction.

Advantageously, as illustrated in FIGS. 1, 2, 4 and 8, the machine 100 comprises first transfer means 12 designed to transfer the pieces 1*a* of filter material from the first movement carousel 2 to the second movement carousel 8.

More specifically, the first transfer means 12 are positioned between the first 2 and the second 8 movement carousel and configured for receiving the pieces 1*a* of filter material from the first gripping means 3 of the first movement carousel 2 and releasing the pieces 1*a* of filter material to the second gripping means 9 of the second movement carousel 8.

Figure 4:
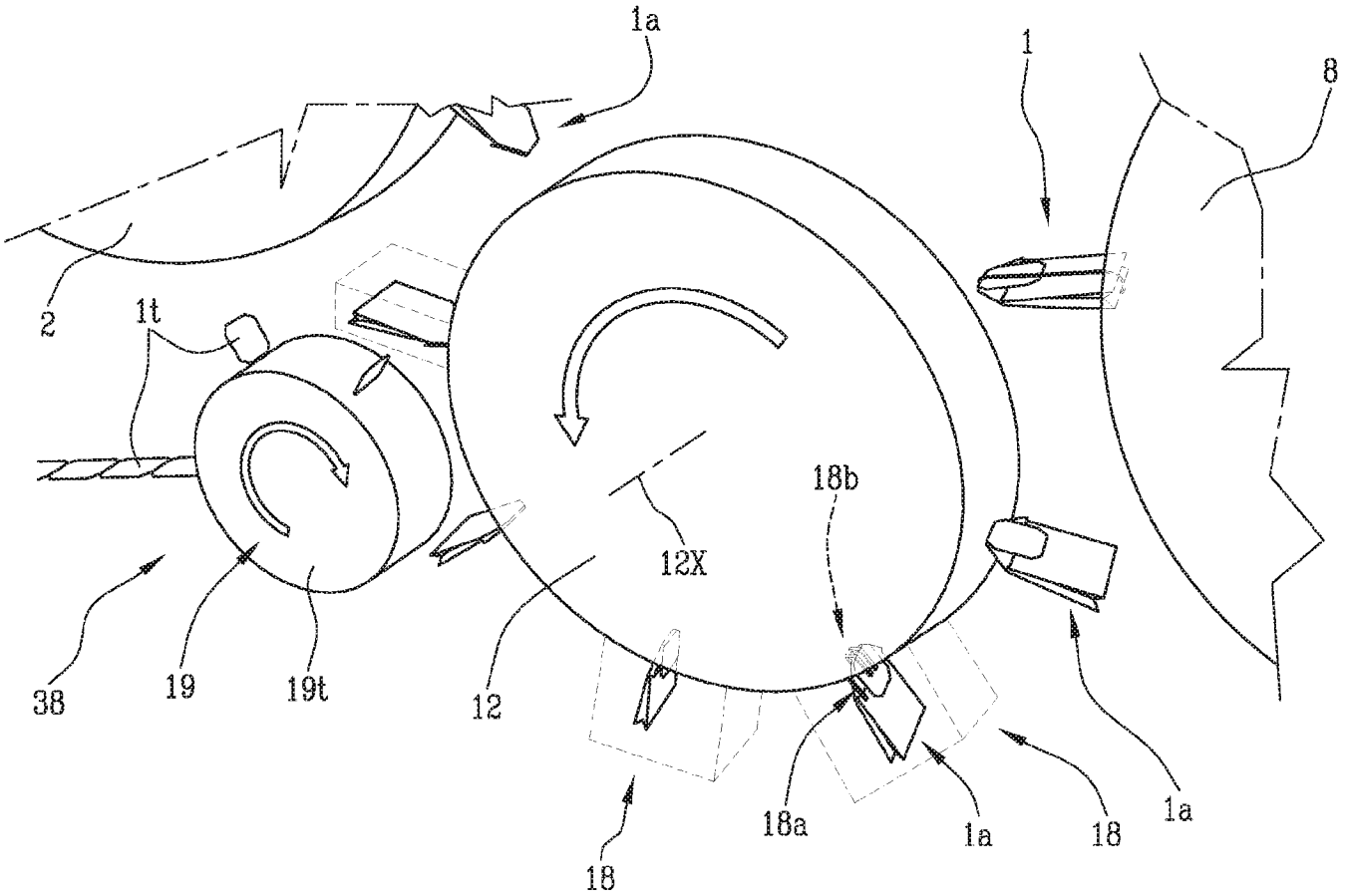
FIG. 4 is a schematic perspective view of first transfer means of the machine of FIGS. 1 and 2.
Figure 5:
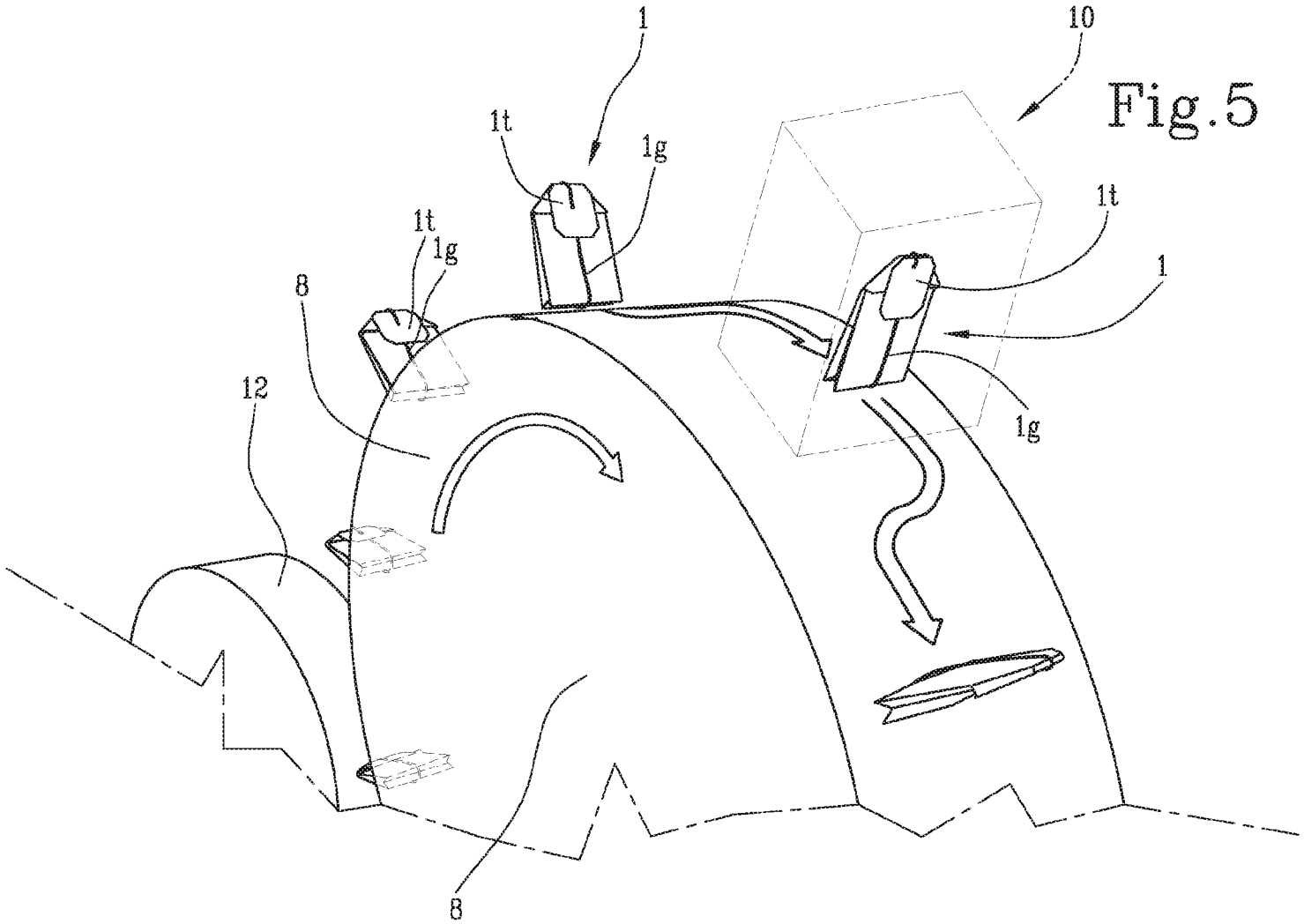
FIG. 5 is a schematic perspective view of a second movement carousel of the machine of FIGS. 1 and 2.
Figure 6:
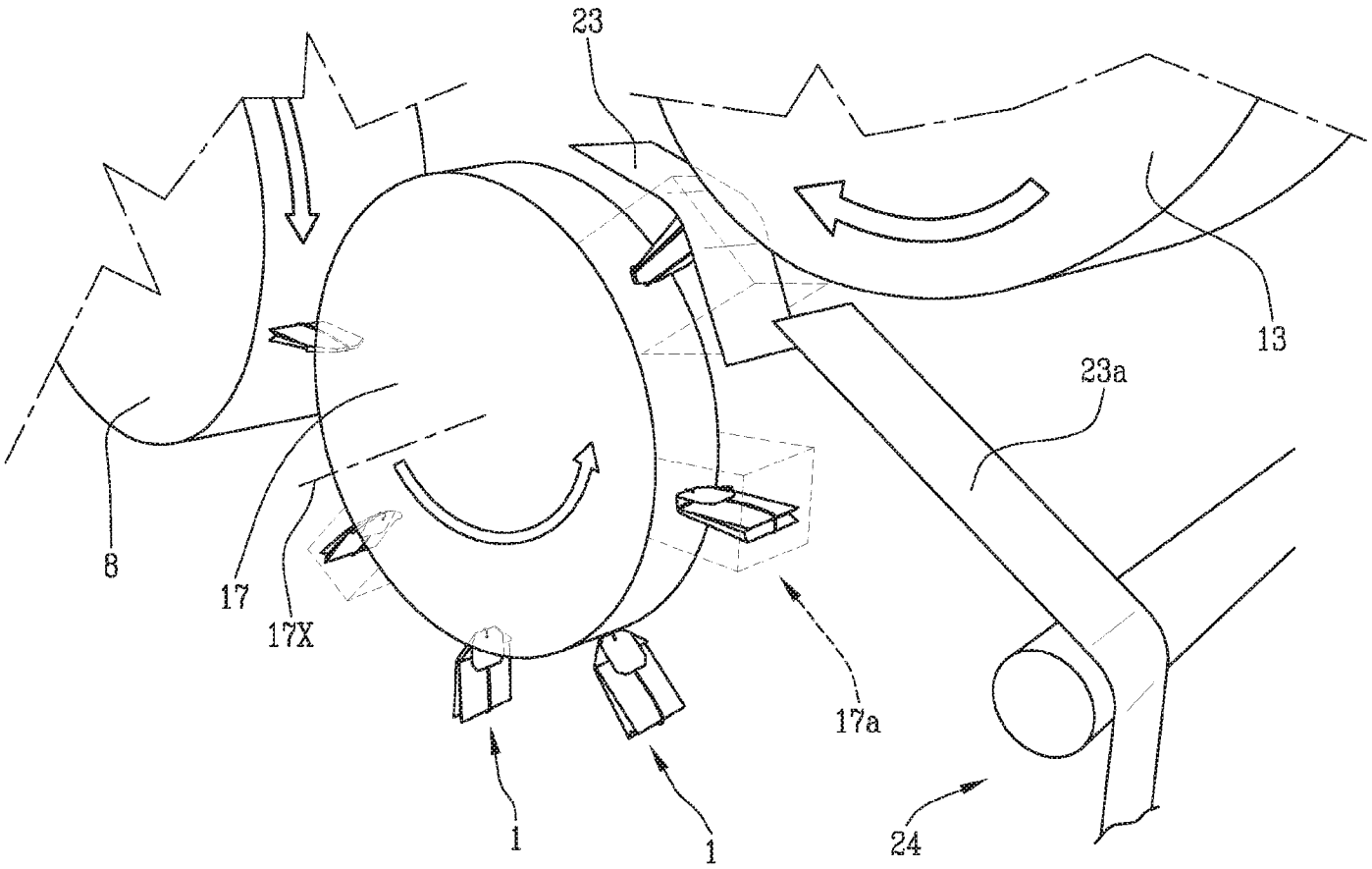
FIG. 6 is a schematic perspective view of the second transfer means and of a third movement carousel of the machine of FIGS. 1 and 2.
Figure 7:
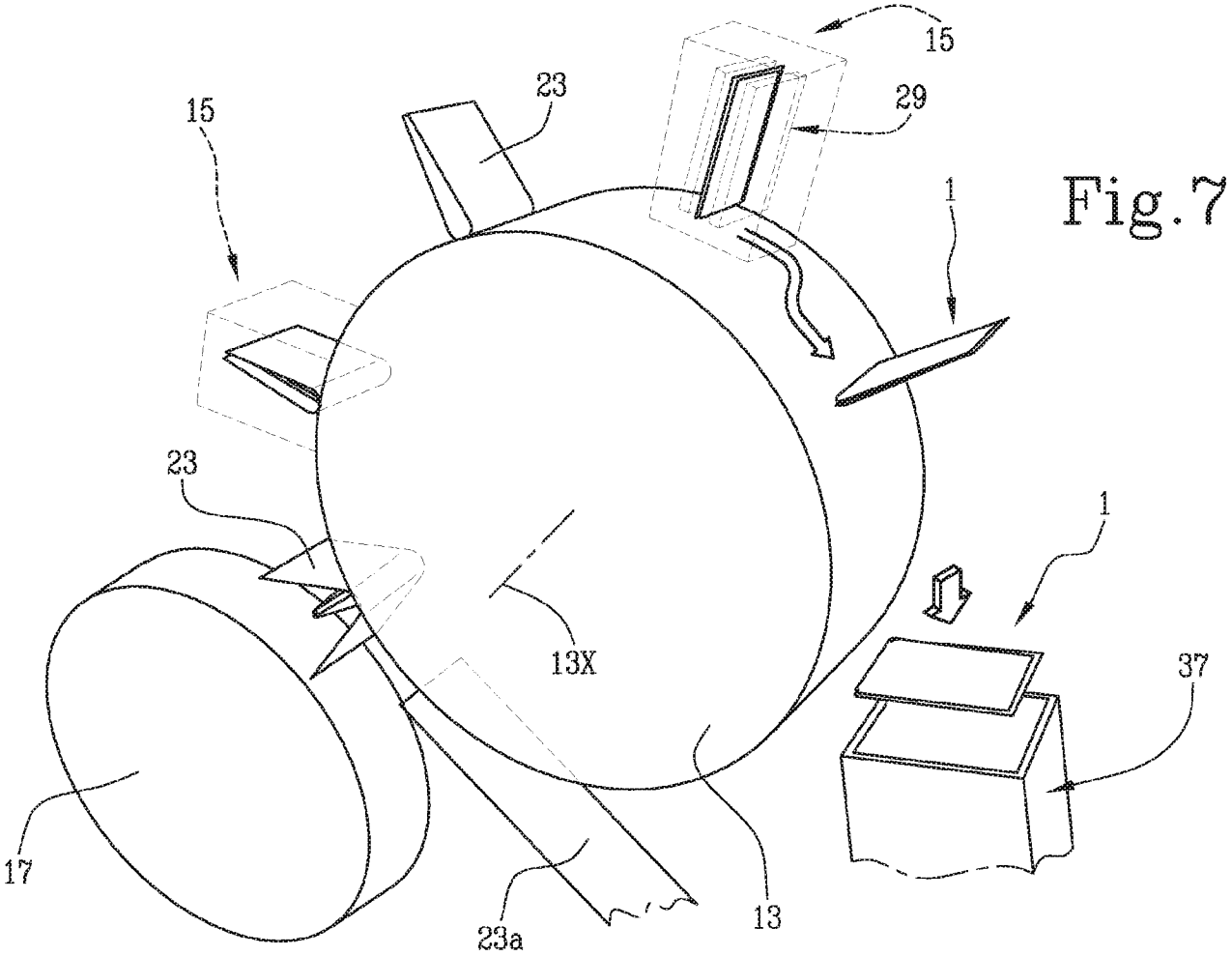
FIG. 7 is a schematic perspective view of the third movement carousel of FIG. 6.

Advantageously, according to the embodiment illustrated in FIG. 4, the first transfer means 12 comprise a first wheel, rotatable continuously about an axis 12X, parallel to the first 2X and to the second 8X axis of rotation, and actuated in a synchronized fashion with the first 2 and the second 8 movement carousel.

The first wheel is equipped, radially, with a plurality of housing units 18 for receiving from first gripping means 3 of the first movement carousel 2, and delivering to second gripping means 9 of the second movement carousel 8, a corresponding piece 1*a* of filter material being formed.

Each receiving unit 18 is equipped with corresponding gripping means 18*a* to hold the piece 1*a* of filter material.

Moreover, each receiving unit 18 is configured for positioning and holding a tag 1*t* on the piece 1*a* of filter material.

In light of this, each receiving unit 18 is equipped with means 18*b* configured for positioning and holding a tag 1*t* at, and in contact with, the two free ends 1*d* and 1*e* of the folded piece 1 of filter material.

Preferably, the continuous rotation of the first wheel is in an anti-clockwise direction.

It should be noted that each piece 1*a* of filter material 1*a* is received and retained in the corresponding housing unit 18 with the bottom radially projecting from first second wheel.

Preferably, the gripping means 18*a* can be grippers for retaining the piece 1*a* of folded filter material, acting on a portion of the free ends 1*d* and 1*e*.

Again preferably, the means 18*b* for the positioning and retaining the tag 1*t* can be further grippers which are able to hold the tag 1*t* again on the free ends 1*d* and 1*e*, in contact with the piece 1 of folded filter material.

Thanks to the presence of the first wheel, the pieces 1*a* of filter material are positioned on the second movement carousel 8 with the bottom facing towards the second axis 8X of rotation.

Advantageously, the joining means 28 (schematically illustrated as a dotted line in FIGS. 4 and 5) contribute to wrap the string 1*g* around the piece 1*a*, whilst the latter passes from the first transfer means 12 to the second movement carousel 8.

As illustrated in FIGS. 1, 2, 7 and 8, the machine 100 comprises a third carousel 13 for continuous rotary movement about a third axis 13X of rotation, positioned alongside the second movement carousel 8.

The machine 100 further comprises a plurality of third gripping means 14 positioned along, and movable continuously with, the third carousel 13.

Each third gripping means 14 is configured to receive, in a synchronised fashion, from the second movement carousel 8, and hold, a respective filter bag 1.

The machine 100 also comprises a plurality of third operating stations 15 positioned along, and movable continuously with, the third carousel 13.

Each third operating station 15 is associated with a corresponding third gripping means 14.

Each third operating station 15 is configured to wind and close a sheet 23 of overwrapping material around the filter bag 1 along at least one predetermined angular stretch of rotation of the third carousel 13.

Advantageously, the third station 15 acts in conjunction with the corresponding third gripping means 14 to retain the respective filter bag 1.

The machine 100 also comprises a plurality of third translation devices 16, associated with the third movement carousel 13 and configured for translating, mutually, the third operating stations 15 and the corresponding third gripping means 14 along a direction parallel to the third axis 13X of rotation.

Advantageously, the third translation devices 16 can be of the cam type, or comprise electric motors.

Preferably, each third operating station 15 and the corresponding third gripping means 14 are positioned on different vertical planes, at least for a stretch of the line A for feeding the pieces 1*a* of filter material being formed.

More specifically, the third operating station 15 and the corresponding third gripping means 14 are positioned offset horizontally, that is, are positioned on different vertical planes, at the infeed area, wherein the filter bag 1 is received from the third gripping means 14, and at an outfeed area of the third movement carousel 13, wherein the filter bag 1 (to which has been applied an outer overwrapping envelope, advantageously heat-sealed) is transferred, for example to a storage system for stacking and boxing.

More specifically, the third carousel 13 has a circumferential surface extending parallel to the third axis 13X.

In light of this, each third operating station 15 is positioned on a first part of the circumferential surface and close to an edge of the third carousel 13.

Each third gripping means 14 is positioned along a second part of the circumferential surface of the third carousel 13 (preferably towards the edge opposite to that close to the corresponding third station 15).

In this way, each third operating station 15 and the corresponding third gripping means 14 are positioned on different vertical planes, referred to the circumferential surface of the third carousel 13, at least for a stretch of the line A for feeding the pieces 1*a* of filter material being formed.

In light of this, each third translation device 16 is configured to translate a corresponding third gripping means 14 along a direction parallel to the third axis 13X of rotation of the third movement carousel 13 to bring a filter bag 1, positioned on the corresponding third gripping means 14, to a corresponding third operating station 15.

The third movement carousel 13 moves the filter bag 1 along a feed direction lying on more than one vertical plane.

In other words, at the third movement carousel 13 the line A for feeding the filter bags 1 lies on more than one vertical plane.

In this example, each third operating station 15 is equipped with sealing means 29 able to wrap and seal a sheet 23 of overwrapping material around the filter bag 1.

Advantageously, the third movement carousel 13 rotates continuously in a clockwise direction.

Preferably, the machine 100 comprises second transfer means 17 designed to transfer, in a synchronised fashion, the filter bag 1 from the second movement carousel 8 to the third movement carousel 13.

In a preferred embodiment, the second transfer means 17 comprise a second wheel continuously rotatable about a corresponding axis 17X according to an anti-clockwise direction.

The second wheel is equipped, radially, with a plurality of housing units 17*a* for receiving from second gripping means 9 of the second movement carousel 8, and delivering to corresponding third gripping means 14 of the third movement carousel 13, a filter bag 1.

It should be noted that each filter bag 1 is accommodated in the corresponding housing unit 17*a* with the bottom radially projecting from the second wheel.

Preferably, each housing unit 17*a* is equipped with retaining grippers, not illustrated, for retaining the filter bag 1.

The purpose of the second wheel is, therefore, to align and feed the filter bags 1 to the third carousel 13.

On the third movement carousel 13 the filter bags 1 are positioned with the bottom facing towards the third axis of rotation 13X.

Preferably, the sealing means 29 (schematically illustrated with a dashed line in FIG. 7), perform a partial winding of the sheet 23 of overwrapping material around the filter bag 1 simultaneously to the passage of the same filter bag 1 from the housing unit 17*a* of the second wheel to the third movement carousel 13 and, subsequently, close and seal the sheet 23 of overwrapping material around the filter bag 1.

After closing and sealing the sheet 23 of overwrapping material, along a predetermined angular stretch of rotation of the third movement carousel 13, the filter bag 1 in the outer overwrapping envelope is discharged.

Preferably, the machine 100 comprises a first feeding station 38 configured for feeding tags 1*t* to any one between the first 2, second 8 and third 13 movement carousel, or to any one between the first 12 and the second 17 transfer means (depending on the machine structure selected).

The feed station 38 comprises unwinding means 19 designed to feed the tags 1*t* in a direction radial to the movement carousels 2, 8 and 13 or to the transfer means 12, 17.

Advantageously, the unwinding means 19 are designed to feed the tags 1*t* in a direction radial to the first wheel of the first transfer means 12.

Preferably, the unwinding means 19 comprise a rotary drum 19*t* having a plurality of seats for retaining individual tags 1*t* fed continuously from a reel.

The rotation of the drum 19*t* moves each single tag 1*t* to a housing unit 18 where it is picked up by the positioning and retaining means 18*b*.

Advantageously, the machine 100 also comprises an unwinding station 20 configured for feeding a continuous string 1*g* to any between the first 2, second 8 and third 13 movement carousel.

In light of this, the unwinding station 20 has unwinding means 21 designed to feed the string 1*g* in a direction substantially tangential to any one between the first 2, second 8 and third 13 movement carousel in such a way as to be intercepted by the pieces 1*a* of filter material being formed held by the first 3, second 9 or third 14 gripping means, respectively.

In the embodiments illustrated in the drawings, the unwinding station 20 has means 21 for unwinding the string 1*g* along a direction tangential to the second movement carousel 8, in such a way as to interpose the string 1*g* between the first wheel of the first transfer means 12 and the second movement carousel 8 in an intercepting area for the second operating stations 10.

Advantageously, the machine 100 comprises a second feed station 22 configured for feeding sheets 23 of overwrapping material to any between the first 2, second 8 and third 13 movement carousel.

In light of this, the feeding station 22 has unwinding means 24 designed to unwind a strip 23*a* of overwrapping material according to a direction tangential to any one between the first 2, second 8 and third 13 movement carousel, in such a way as to be intercepted by the filter bags 1 held by the first 3, second 9 or third 14 gripping means, respectively.

In the embodiments illustrated in the drawings, the unwinding means 24 are configured to unwind the strip 23*a* of overwrapping material according to a direction tangential to the third carousel 13 and in such a way as to interpose the strip 23*a* of overwrapping material between the second wheel of the second transfer means 17 and the third movement carousel 13 in an intercepting area for the third operating stations 15. In this solution illustrated, the third operating stations 15 comprise cutting means for making single sheets 23 of overwrapping material starting from the strip 23*a*.

As illustrated in the drawings, the first 2, second 8 and third 13 movement carousel have corresponding supporting shafts 2*a*, 8*a*, 13*a* connected to a drive unit 25 configured for continuously moving the corresponding supporting shafts 2*a*, 8*a*, 13*a*.

In light of this, the drive units 25 are controlled by a control unit 26 to rotate in a synchronized fashion the first 2, second 8, and third 13 movement carousel.

Preferably, in the embodiment illustrated, the first and the second wheel of the first 12 and second 17 transfer means, respectively, have corresponding supporting shafts 12*c* and 17*c* connected to a drive unit 25 controlled by the control unit 26 for continuously moving the two wheels in a synchronized fashion with the movement carousels.

Advantageously, the machine 100 also comprises a stacking station 37 configured to receive the filter bags 1 formed by any one of the first 2, second 8 and third 13 movement carousel.

In the embodiments illustrated, the stacking station 37 is positioned downstream of, and adjacent to, the third movement carousel 13, for receiving filter bags 1 outer overwrapping envelopes.

Alternatively, the stacking station 37 can be positioned downstream of, and adjacent to, the second movement carousel 8*di*, for receiving "naked" filter bags 1, that is, without the outer overwrap heat-sealed envelope (see the dashed line 37 in FIG. 2).

The preset aims are fully achieved with the machine structure just described.

In effect, a machine according to the invention is extremely flexible, configurable as a function of the filter bag to be made, and with a high productivity.

It should be noted that each individual operation on the piece of filter material, or on the filter bag, is no longer linked to the pause time (as in the machines with step-mode operation) and has a duration independent from one another. It is therefore possible to lengthen or shorten, as necessary, the time of execution of an operation (for example, folding the piece of filter material, or adding string and tag to the piece of filter material, or sealing the sheet of overwrapping material) simply by using a longer or shorter stretch of rotation of the movement carousels.

It should be noted that a machine according to the preferred embodiment of the invention according to which the translation devices move the filter bag (that is, the gripping means) and the operating stations remain stationary relative to the respective movement carousel is particularly simple from the constructional point of view.

Each unit may operate on the piece of filter material along an extremely short arcuate stretch of the carousel and, thanks to the presence of the translation devices, may receive and release the piece quickly and with the possibility of starting the operations immediately, reducing the down times and the dimensions of the machine.

The invention claimed is:

1. A machine for making filter bags for infusion products starting from individual pieces of filter material, each of the filter bags containing at least one dose of infusion product and advancing along a feed line, comprising:

a first movement carousel for continuous rotary movement about a first axis of rotation;

a plurality of first gripping devices including grippers positioned along, and continuously movable with, the first movement carousel, each of the first gripping devices being configured for holding a respective piece of filter material being formed;

a plurality of first operating stations positioned along, and continuously movable with, the first movement carousel, each first operating station including a corresponding one of the first gripping devices and being configured to operate on the piece of filter material in order to form, at least partly, a filter bag along at least one predetermined angular stretch of rotation of the first movement carousel;

a plurality of first translation devices, associated with the first movement carousel and configured for translating, mutually, the first operating stations and the corresponding ones of the first gripping devices along a direction parallel to the first axis of rotation, the first translation devices including at least one chosen from a cam mechanism and an electric motor for performing the translating.

2. The machine according to claim 1, wherein the first movement carousel has a circumferential surface extending parallel to the first axis, and wherein each first operating station is positioned on a first part of the circumferential surface and close to an edge of the first movement carousel, and wherein each of the first gripping devices is positioned along a second part of the circumferential surface of the first movement carousel; each first operating station and the corresponding one of the first gripping devices being positioned on different vertical planes, in reference to the circumferential surface of the first movement carousel, at least for a stretch of the feed line for feeding the pieces of filter material being formed.

3. The machine according to claim 1, wherein each first translation device is configured to translate the corresponding one of the first gripping devices along a direction parallel to the first axis of rotation of the first movement carousel to bring the piece of filter material, positioned on the corresponding one of the first gripping devices to the corresponding first operating station.

4. The machine according to claim 1, wherein the first translation devices are configured to translate the first operating stations along a direction parallel to the first axis of rotation of the first movement carousel to bring the first operating stations to the respective pieces of filter material at least for a stretch of the feed line.

5. The machine according to claim 1, and further comprising cutting devices including cutting blades positioned on, and movable in rotation with, the first movement carousel, each of the cutting devices being positioned between, and associated with, one of the first operating stations and the corresponding one of the first gripping devices for separating from a continuous strip of filter material the individual pieces of filter material.

6. The machine according to claim 1, comprising a forming unit configured for forming, and feeding to the first movement carousel, the individual pieces of filter material each containing at least one dose of product along the feed line.

7. The machine according to claim 1, wherein each first operating station is configured to operate on one of the individual pieces of filter material in order to form a complete filter bag along at least one predetermined angular stretch of rotation of the first movement carousel.

8. The machine according to claim 1, wherein the first operating station is any one chosen from a station for applying string and tag, a station for folding and closing the piece of filter material, and a station for applying and sealing a sheet of overwrapping material.

9. The machine according to claim 1, comprising:

a second movement carousel for continuous rotary movement about a second axis of rotation, positioned alongside the first movement carousel;

a plurality of second gripping devices including grippers positioned along, and continuously movable with, the second movement carousel, each of the second gripping devices being configured for receiving and holding one of the pieces piece of filter material being formed;

a plurality of second operating stations positioned along, and continuously movable with, the second movement carousel, each second operating station including a corresponding one of the second gripping devices and being configured to operate on the piece of filter material in order to further form, at least partly, a filter bag along at least one predetermined angular stretch of rotation of the second movement carousel; and a plurality of second translation devices, associated with the second movement carousel and configured for translating, mutually, the second operating stations and the corresponding ones of the second gripping devices along a direction parallel to the second axis of rotation the second translation devices including at least one chosen from a cam mechanism and an electric motor for performing the translating.

10. The machine according to claim 9, wherein the second movement carousel has a circumferential surface extending parallel to the second axis, and wherein each second operating station is positioned on a first part of the circumferential surface and close to an edge of the second movement carousel, and wherein each of the second gripping devices is positioned along a second part of the circumferential surface of the second carousel; each second operating station and the corresponding one of the second gripping devices being positioned on different vertical planes, in reference to the circumferential surface of the second movement carousel, at least for a stretch of the feed line for feeding the pieces of filter material being formed.

11. The machine according to claim 9, wherein each second translation device is configured to translate the corresponding one of the second gripping devices along a direction parallel to the second axis of rotation of the second movement carousel to bring a piece of filter material, positioned on the corresponding one of the second gripping devices, to the corresponding second operating station.

12. The machine according to claim 9, wherein the second translation devices are configured to translate the corresponding second operating stations along a direction parallel to the second axis of rotation of the second movement carousel to bring the corresponding second operating stations to the pieces of filter material at least for a stretch of the feed line.

13. The machine according to claim 9, and further comprising a first transfer device including a first rotatable wheel synchronized between the first movement carousel and the second movement carousel to transfer the pieces of filter material from the first movement carousel to the second movement carousel.

14. The machine according to claim 9, wherein the second operating stations are configured to operate on a respective piece of filter material and form a complete filter bag along at least one predetermined angular stretch of rotation of the second movement carousel, wherein the second operating stations are any one chosen from stations for applying string and tag and stations for applying and sealing a sheet of overwrapping material provided with sealing units.

15. A machine according to claim 9, comprising:

a third movement carousel for continuous rotary movement about a third axis of rotation, positioned alongside the second movement carousel;

a plurality of third gripping devices including grippers positioned along, and continuously movable with, the third movement carousel, each of the third gripping devices being configured for receiving and holding a respective filter bag;

a plurality of third operating stations positioned along, and continuously movable with, the third movement carousel, each third operating station including a corresponding one of the third gripping devices and further including heat sealers to seal an overwrapping material on the respective filter bag along at least one predetermined angular stretch of rotation of the third movement carousel; and a plurality of third translation devices, associated with the third movement carousel and configured for translating, mutually, the third operating stations and the corresponding one of the third gripping devices along a direction parallel to the third axis of rotation, the third translation devices including at least one chosen from a cam mechanism and an electric motor for performing the translating.

16. The machine according to claim 15, wherein the third movement carousel has a circumferential surface extending parallel to the third axis, and wherein each third operating station is positioned on a first part of the circumferential surface and close to an edge of the third movement carousel, and wherein each of the third gripping devices is positioned along a second part of the circumferential surface of the third movement carousel; each third operating station and the corresponding one of the third gripping devices being positioned on different vertical planes, in reference to the circumferential surface of the third movement carousel, at least for a stretch of the feed line for feeding the pieces of filter material being formed.

17. The machine according to claim 15, wherein each third translation device is configured to translate the corresponding one of the third gripping devices along a direction parallel to the third axis of rotation of the third movement carousel to bring the respective filter bag, positioned on the corresponding third gripping device, to a corresponding third operating station.

18. The machine according to claim 15, and further comprising a second transfer device including a second rotatable wheel synchronized between the second movement carousel and the third movement carousel to transfer, in a synchronized fashion, the filter bags from the second movement carousel to the third movement carousel.

19. The machine according to claim 13, wherein the first transfer device comprises a first wheel, rotatable continuously about an axis, and actuated in a synchronized fashion with the first movement carousel and the second movement carousel; the first wheel being equipped, radially, with a plurality of units for receiving from the corresponding first gripping devices of the first movement carousel, and releasing to the second gripping devices of the second movement carousel, a corresponding piece of filter material being formed; each receiving unit being equipped with corresponding gripping device for holding the piece of filter material; the receiving unit being configured for positioning and holding a tag on the piece of filter material.

20. The machine according to claim 18, and further comprising a first feeding station configured for feeding tags to any one between the first, second and third movement carousels, or to any one between the first and the second transfer means; the first feeding station including an unwinding rover configured to feed the tags in a radial direction to the first, second or third movement carousels or to the first transfer device.

21. The machine according to claim 15, and further comprising an unwinding roller configured for feeding a continuous string to any one between the first, second and third movement carousel; the unwinding roller configured to feed the string in a direction substantially tangential to any one between the first, second and third movement carousels in such a way as to be intercepted by the pieces of filter material being formed held by the first, second or third gripping devices, respectively.

22. The machine according to claim 15, and further comprising a second feeding station configured for feeding a strip of overwrapping material to any one between the first, second and third movement carousels; the second feeding station including an unwinding roller configured to unwind the strip of overwrapping material according to a direction tangential to any one between the first, second and third movement carousels, in such a way as to be intercepted by the filter bags held by the first, second or third gripping devices, respectively.

23. The machine according to claim 15, wherein the first, second and third movement carousels have corresponding supporting shafts connected to corresponding drive units configured for continuously moving the corresponding supporting shafts.

24. The machine according to claim 23, and further comprising a control unit for controlling the corresponding drive units to rotate in a synchronized fashion the first, second, and third movement carousels.

* * * * *